US005469773A

United States Patent [19]

Tarpinian

[11] Patent Number: 5,469,773

[45] Date of Patent: Nov. 28, 1995

[54] LIGHT WEIGHT ARMOR

[75] Inventor: Aram Tarpinian, Waltham, Mass.

[73] Assignee: The United States of America as represented by the Secretary of the Army, Washington, D.C.

[21] Appl. No.: 490,779

[22] Filed: Sep. 23, 1965

[51] Int. Cl.[6] ..... F41H 5/04

[52] U.S. Cl. ..... 89/36.02; 428/911; 501/127

[58] Field of Search ..... 89/36, 36.01, 36.02; 2/2.5; 106/65, 121; 161/404, 183; 428/412, 911, 501; 501/127

[56] References Cited

U.S. PATENT DOCUMENTS 1,423,652 7/1922 Edmondson ..... 89/36 AU X 3,324,768 6/1967 Eichelberger ..... 89/36 A 3,509,833 5/1970 Cook ..... 89/36.02

*Primary Examiner*—Stephen C. Bentley

*Attorney, Agent, or Firm*—Freda L. Krosnick; Muzio B. Roberto

[57] ABSTRACT

A light weight ceramic armor providing complete ballistic protection against penetration from projectiles of caliber 0.30 and 7.62 mm. armor piercing and ball projectiles, and consisting of a composite having a hard frangible facing the principle ingredient of which is a refractory oxide selected from the group consisting of magnesium oxide and aluminum oxide, bonded to a reinforced plastic back-up such as laminated fiber glass. This composite has an area density of approximately 12 pounds per square foot and provides approximately 1.7 times the ballistic protection as compared to standard steel armor of equal area density.

3 Claims, 1 Drawing Sheet

LIGHT WEIGHT ARMOR

The invention described herein may be manufactured and used by or for the Government for governmental purposes, without the payment to me of any royalty thereon.

This invention relates to materially lighter weight armor designed particularly for aircraft where weight is of vital importance.

Standard steel armor due to the excess weight involved is not adaptable for protection of aircraft.

It is therefore the object of this invention to provide ceramic armor which is materially lighter and affords better protection than standard steel armor against small arms projectiles.

Such armor comprises a composite material consisting of a ceramic facing and a reinforced plastic back-up bonded together to produce a single plate in which the facing is extremely hard and frangible while the back-up is composed of a relatively tough resilient material. When a mass or a projectile strikes the facing of the composite plate and shatters the hard ceramic layer cracks and in so doing distributes the impact over a relatively wide area so that the impact force per unit is substantially reduced. The hard ceramic layer serves as a means of breaking up the projectile and also provides a means for distributing the impact. On the other hand, the resilient back-up material absorbs the excess force, if any, by converting it into kinetic energy and resisting penetration by the fragments of the projectile and the facing material.

Figure 1:
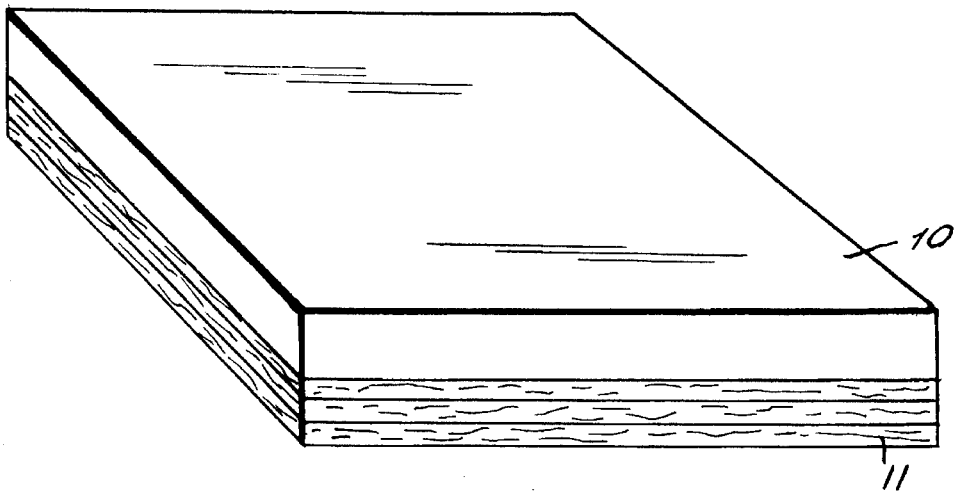
FIG. 1 is a perspective view of the composite protective armor plate in accordance with this invention.

Reference is made to the illustration shown in FIG. 1, in which a shield 10, penetration resistant to a projectile or its fragments, is composed of a facing of hot pressed magnesium oxide-glass ceramic, a material that is hard and frangible and is backed-up by a tough resilient plate 11 of fiberglass-reinforced plastic laminate. The facing 10 and the back-up plate 11 are bonded together with a flexible silicone rubber adhesive (not illustrated) to form a composite plate.

Figure 2:
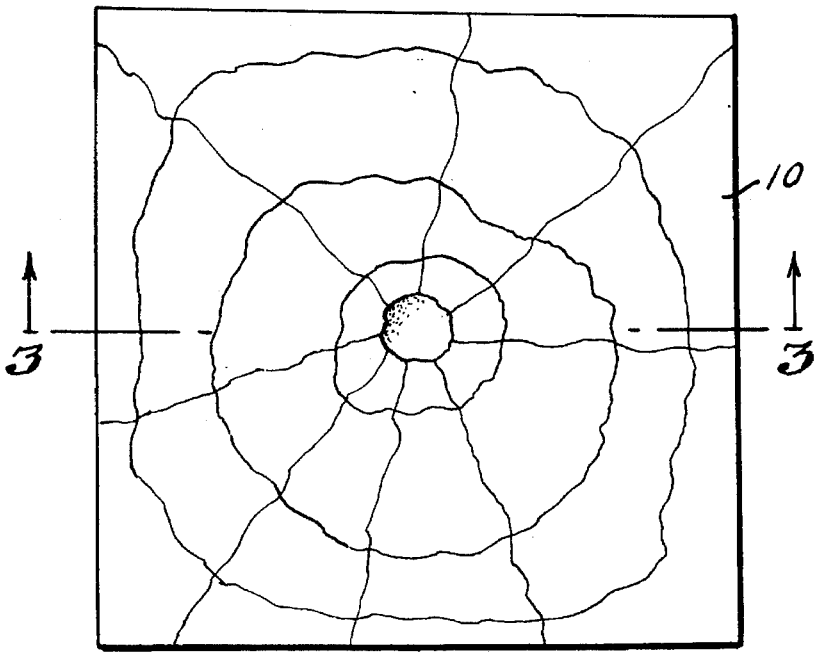
FIG. 2 is a top view of the same plate as it appears after the impact of a projectile such as caliber 0.30 APM2.

FIG. 2 is a representation showing the cracking of the frangible shield 10 after impact with a projectile which is shattered on contact with the hard ceramic facing. This figure is intended to depict the overall cracking of the shield 10 which spreads the impact force over a greater area than metallic armor and therefore greatly reduces the impact force per unit area.

Figure 3:
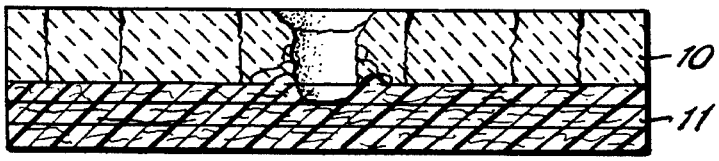
FIG. 3 is a cross-sectional view taken along the 3—3 line of FIG. 2.

FIG. 3 shows the penetration of the cracked shield 10 by the shattered projectile wherein the resilient back-up plate absorbs any excess energy from the force of impact together with any fragments from the facing and the projectile.

As a practical application of this lighter weight ceramic armor, it was tested for durability against a projectile, such as caliber 0.30 APM2 with the APM2 denoting Armor Piercing Modification 2. The thickness of the ceramic facing is the minimum required to shatter the projectile and spread its force of impact over a large area while the thickness of the back-up material is also the minimum necessary to support the facing and dissipate the excess energy of impact and the resulting fragments for sufficient resistance to penetration and a satisfactory performance. Such a performance was obtained by using a composite of a hot pressed hard facing of 92% magnesium oxide plus 8% glass with a thickness of 0.360 inches bonded to a reinforced plastic back-up material with a thickness of 0.50 inches. It should be noted that the cracking of the face plate on impact to spread and reduce the impact force per unit area results in a reduction of excess force per unit area to be absorbed by the back-up plate. Thus the action of the face plate materially reduces the requirements of the back-up plate. The face plate then, has a capability of performing a three-fold function, namely, the shattering of the projectile, the cracking to reduce the impact force per unit area, and the proportionate reduction of the excess force to be absorbed by the back-up plate which reduces the requirements for that plate. Complete protection is afforded by this composite with an area density of 11.8 pounds per square foot against caliber 0.30 APM2 projectile at point blank range and standard muzzle velocities. Results showed that the composite ceramic armor has a resistance appreciably higher than that of standard steel armor, such as a "merit rating" of 1.7, which is defined as the ballistic limit of the candidate armor divided by the ballistic limit of standard steel armor having an equal area density.

Aluminum-oxide fiberglass reinforced composites have been evaluated and the substitution of aluminum oxide for magnesium oxide has been found to be equally adaptable and suitable for this type of armor.

In the foregoing, the preferred embodiment of this invention has been disclosed. However, it is not intended that this invention be limited to the specific examples set forth above, as it will be apparent to those skilled in the art, that the proportions of the ingredients may be varied and a variety of equivalent substances may be employed without departing from the spirit of the invention or exceeding the scope of the appended claims.

What is claimed is:

1. Ceramic armor comprising a composite with an area density of 11.8 pounds per square foot consisting of a hot pressed facing having a composition of 92% magnesium oxide and 8% glass adapted to crack on impact of a projectile to spread and reduce the impact force per unit area, said facing being bonded to a laminated plastic back-up plate to absorb the reduced excess energy due to the wider distribution of the impact force on the facing and to thereby provide complete ballistic protection against caliber 0.30 armor piercing projectile at muzzle velocity.

2. Ceramic armor comprising a light weight integral composite with an area density of 11.8 pounds per square foot consisting of a hot pressed ceramic face plate 0.360 inches thick having a composition of 92% magnesium oxide and 8% glass adapted to crack on impact of a projectile and bonded to a laminated plastic back-up plate 0.50 inches thick to absorb the reduced excess energy from impact due to the wider distribution of the force on the face plate so constructed and arranged that the cracking of the face plate produces a reduction in impact force per unit area and permits the materially lighter weight composite armor to afford 1.7 times the protection of standard steel armor of equal area density.

3. Ceramic armor comprising a light weight composite integral plate resistant to penetration by small arms projectiles, consisting of a hard frangible ceramic face plate of 92% magnesium oxide and 8% glass bonded to a reinforced plastic back-up plate, said face plate so constructed and arranged to perform on impact of projectile the functions of, shattering the projectile, cracking of the face plate to spread and reduce the impact force per unit area, and reducing the limits of excess force to be absorbed by the back-up plate due to the wider distribution of force by the face plate.

* * * * *